US005772447A

United States Patent [19]

Cheung

[11] Patent Number: 5,772,447

[45] Date of Patent: Jun. 30, 1998

[54] PIVOTING ELECTRICAL PLUG

[75] Inventor: Tat Kwong Cheung, Kowloon, Hong Kong

[73] Assignee: Koontat Development Co. Ltd., San Po Kong Kowloon, Hong Kong

[21] Appl. No.: 659,649

[22] Filed: Jun. 6, 1996

Related U.S. Application Data

[63] Continuation-in-part of Ser. No. 607,007, Feb. 26, 1996.

[51] Int. Cl.[6] ..... H01R 39/00

[52] U.S. Cl. ..... 439/31

[58] Field of Search ..... 439/11, 31, 13, 439/8, 10

[56] References Cited

U.S. PATENT DOCUMENTS

| | | | |
|---|---|---|---|
| 861,468 | 7/1907 | Kreinsen | 439/11 |
| 3,474,376 | 10/1969 | Preiss . | |
| 4,504,104 | 3/1985 | Leong et al. . | |
| 5,249,970 | 10/1993 | Jennings | 439/11 |

FOREIGN PATENT DOCUMENTS

| | | |
|---|---|---|
| 2 266 330 | 10/1975 | France . |
| 31 08 743.A1 | 9/1982 | Germany . |
| 93 08 317.3 | 9/1993 | Germany . |

*Primary Examiner*—Neil Abrams
*Assistant Examiner*—Eugene G. Byrd
*Attorney, Agent, or Firm*—Bacon & Thomas

[57] ABSTRACT

An electrical plug is disclosed in which the plug body having the electrically conductive pins is pivotally attached to an attachment body such that the plug body and attachment body may pivot with respect to each other about a pivot axis. The attachment body is connected to an electrical wire and the electrical conductors in the wire are connected to each of the conductive pins at the pivot axis so as not to interfere with the pivoting motion between the plug body and the attachment body. Such pivoting movement enables the plug body to be oriented in substantially any fashion with respect to the electric wire. The wire may extend from a side of the plug body, or outwardly from the plug body opposite the electrically conductive pins. Such pivoting movement enables the electrical device to which the wire is connected to be located virtually anywhere with respect to an electrical outlet. The plug body may be oriented to engage the outlet irrespective of the direction in which the electric wire must proceed from the plug.

9 Claims, 11 Drawing Sheets

PIVOTING ELECTRICAL PLUG

RELATED PATENT APPLICATIONS

This application is a continuation-in-part of U.S. patent application Ser. No. 08/607,007 filed on Feb. 26, 1996.

BACKGROUND OF THE INVENTION

The present invention relates to an electrical plug, more particularly such an electrical plug in which the plug body having electrically conductive pins extending therefrom is pivotable with respect to an attachment body connected to the electrical wire.

Electrical plugs are, of course, well known in the art and typically comprise a plug body having electrically conductive pins extending therefrom connected to an electrical wire through the plug body. The plug body is usually fixedly connected to the electrical wire such that the electrical wire extends directly outwardly from the plug body, or outwardly through a side of the plug body. The location of the electrical socket into which the electrical plug is placed and the electrical device connected to the electrical wire may necessitate a specific relationship between the electrically conductive wire and the plug body. If the electrical outlet has limited access, it may be necessary to use a plug body having the electrical wire extending out the side of the plug, or, in the alternative, the location of the electrical device in front of the electrical outlet may necessitate for the electrical wire to extend directly outwardly from the plug body.

The electrical plugs attached to the wires of electrical devices, such as lamps, stereos, kitchen appliances, and extension cords typically are fixed relative to the electric wire preventing any change in the relative orientation of between the electrical wire and the plug body. Depending upon the location in which the electrical device is utilized, this fixed relationship between the plug body and the electrical wire may prevent usage of the electrical device, or may be inconvenient to the user.

SUMMARY OF THE INVENTION

An electrical plug is disclosed in which the plug body having the electrically conductive pins is pivotally attached to an attachment body such that the plug body and attachment body may pivot with respect to each other about a pivot axis. The attachment body is connected to an electrical wire and the electrical conductors in the wire extend into the plug body along the pivot axis so as not to interfere with the pivoting motion between the plug body and the attachment body. Such pivoting movement enables the plug body to be oriented in substantially any fashion with respect to the electric wire. The wire may extend from a side of the plug body, or outwardly from the plug body opposite the electrically conductive pins. Such pivoting movement enables the electrical device to which the wire is connected to be located virtually anywhere with respect to an electrical outlet. The plug body may be oriented to engage the outlet irrespective of the direction in which the electric wire must proceed from the plug.

The pivoting electrical plug according to the present invention may be utilized with a two conductor electrical wire in which the plug body has two conductive pins extending therefrom, or with a three conductor electrical wire in which one of the conductors is a ground conductor and which has three conductive pins extending from the plug body. In a two conductor electrical plug, the conductors from the electric wire are connected to each of the conductive pins extending from the plug body. The wires may be directly attached to each of the conductive pins, or may be connected thereto via an electrical contact formed on the conductive pin and an electrical contact connected to one of the conductors of the electrical wire. The electrical contact formed on the conductive pin assumes a concave, generally hemispherical configuration with the concave surface in physical and electrical contact with either an elongated member spring biased into physical contact with the concave surface and connected to one of the electrical conductors, or by a convex, generally hemispherical contact formed as part of a resilient member which, in turn, is physically connected to the electrical wire conductor.

In a three wire plug, the ground conductor may be directly attached to the conductive ground pin extending from the plug body, or the conductive pin may be attached to a ground plate having generally cylindrical ground contacts which are engaged by arcuate contacts formed on a separate ground plate physically attached to the ground conductor in the electrical wire. The conductive pin contacts, as well as the ground contacts are located on the pivot axis between the plug body and the attachment body, thereby enabling full movement of the plug body relative to the attachment body while maintaining electrical contact between the conductive pins and the electrical wire.

DETAILED DESCRIPTION OF THE PREFERRED EMBODIMENTS

Figure 1C:
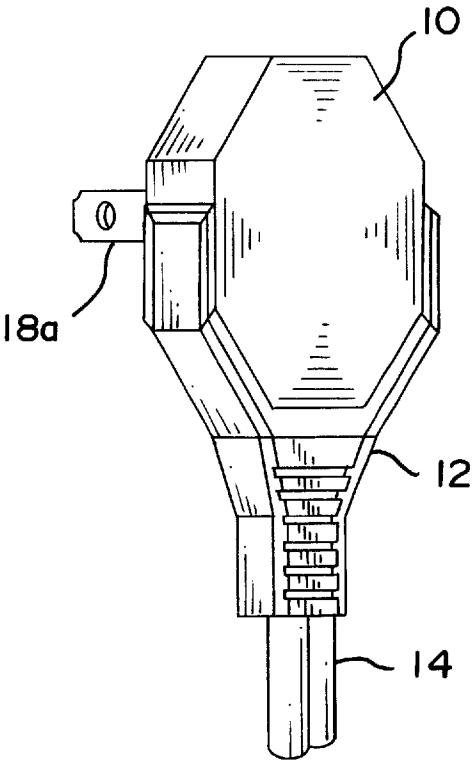
FIGS. 1A–1C are perspective views of the pivoting electric plug according to the present invention illustrating various respective positions of the plug body and the attachment body.
Figure 1B:
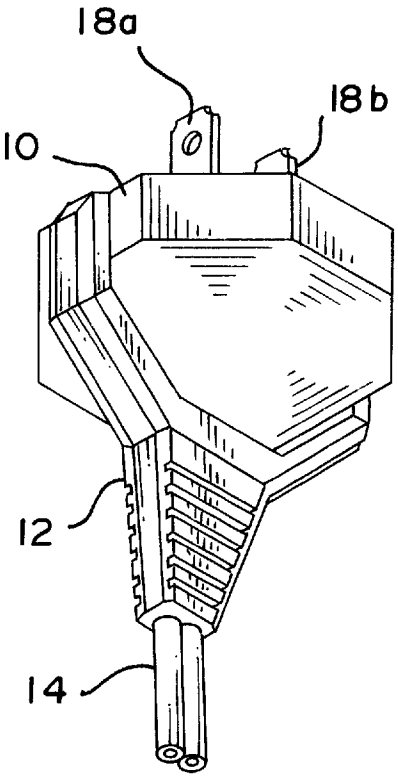
Figure 1A:
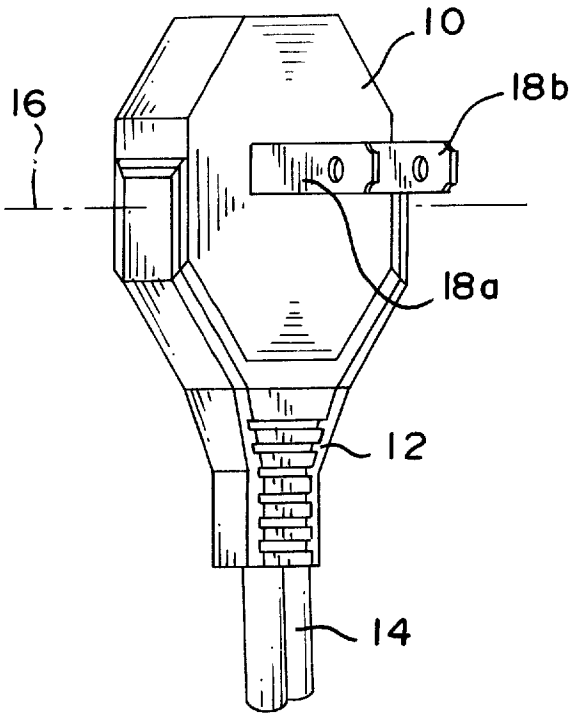

The electrical plug according to the present invention has a plug body 10 pivotally attached to an attachment body 12 which is, in turn, connected to an electrical wire 14. As can be seen in FIGS. 1A–1C, the plug body 10 is pivotally attached to the attachment body 12 such that the elements are relatively pivotable with respect to each other about pivot axis 16. Although FIGS. 1A–1C illustrate the electrical plug body having an octagonal configuration, it is to be understood that the plug body can assume other configurations without exceeding the scope of this invention. As will be described in more detail, the invention encompasses a pivoting electrical plug having two conductive pins connected to an electrical wire having two conductors, as illustrated in FIGS. 1A–1C, as well as the plug body having three conductive pins, including a ground pin, connected to a three conductor electrical wire. Additional pins may be included as necessary without exceeding the scope of the invention. When the plug body 10 has "low profile", or a relatively small thickness, the attachment body 12 may be used to pull the plug from a socket, as illustrated in FIG. 1B.

Figure 2:
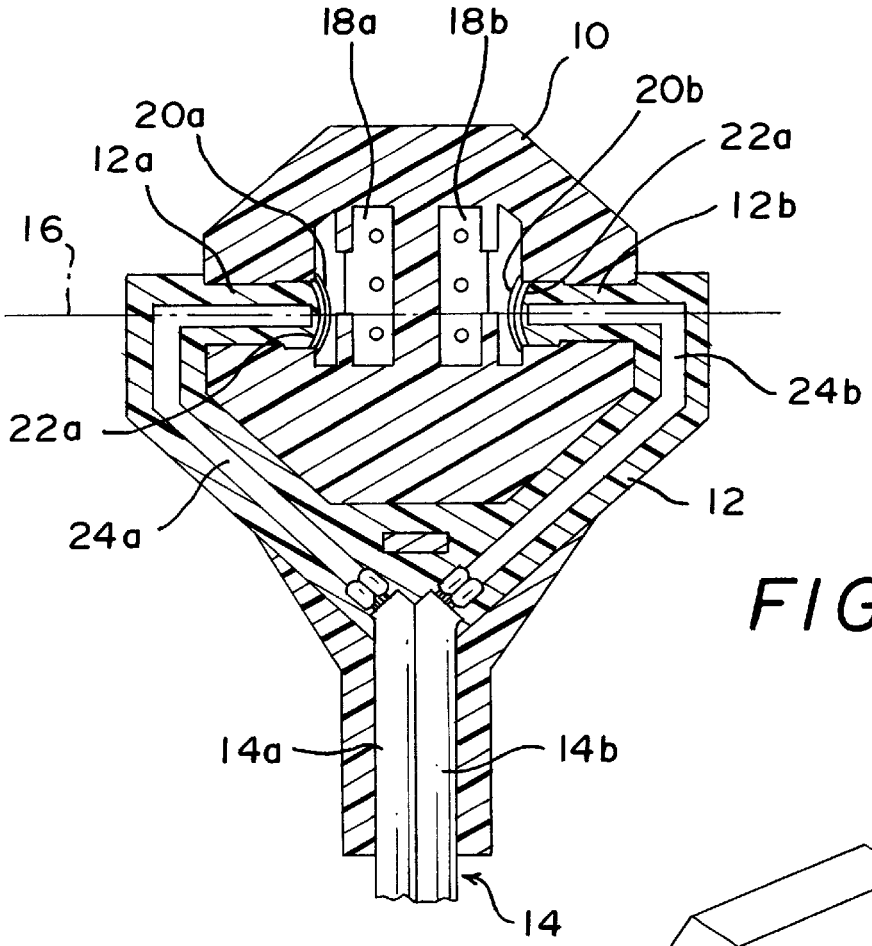
FIG. 2 is a cross-sectional view of a first embodiment of the pivoting electrical plug according to the present invention.
Figure 3:
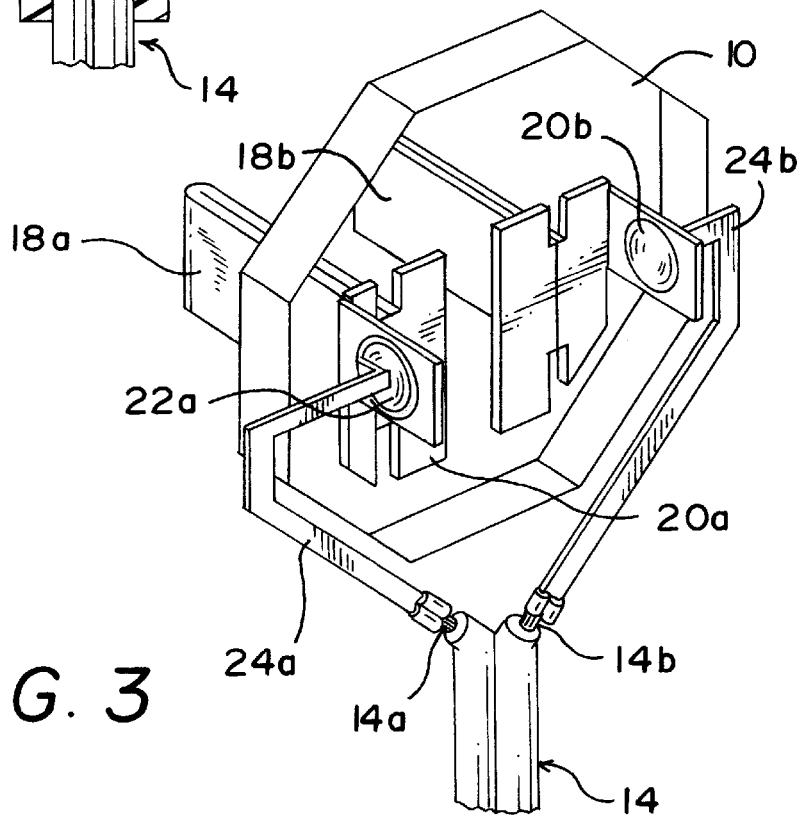
FIG. 3 is a schematic, perspective view of the electrical plug illustrated in FIG. 2.
Figure 5:
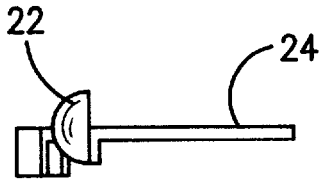
FIG. 5 is a side view of the convex contact and connecting member illustrated in FIG. 4.
Figure 6:
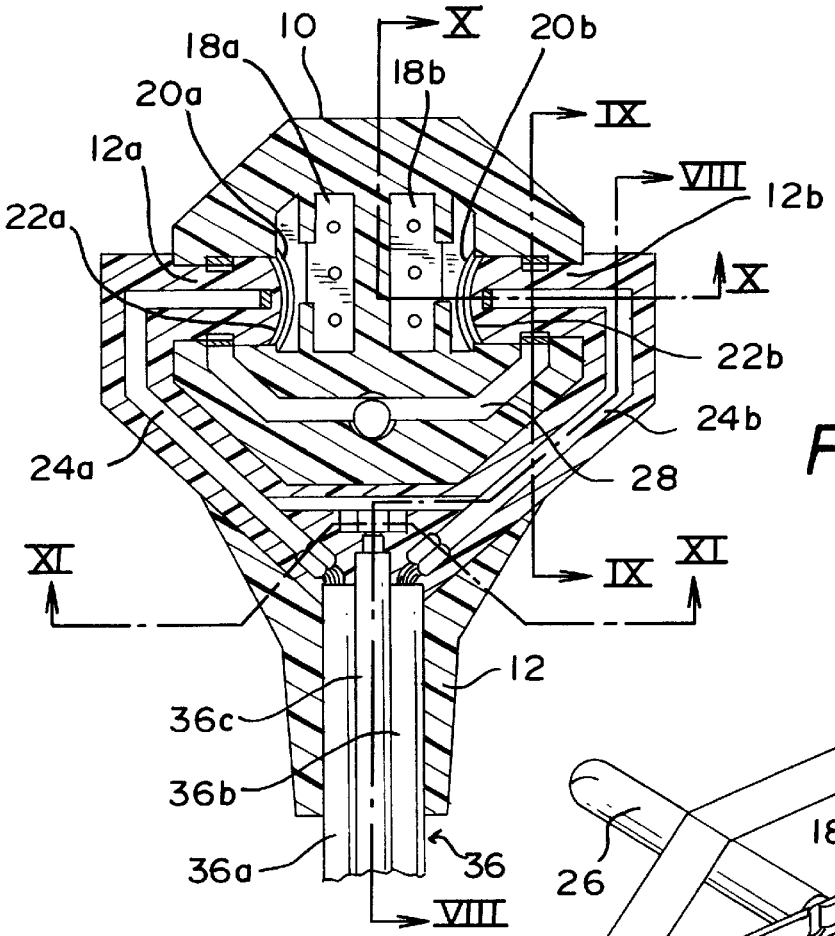
FIG. 6 is a cross-sectional view of the embodiment of FIG. 2 having three conductive pins including a ground pin.
Figure 7:
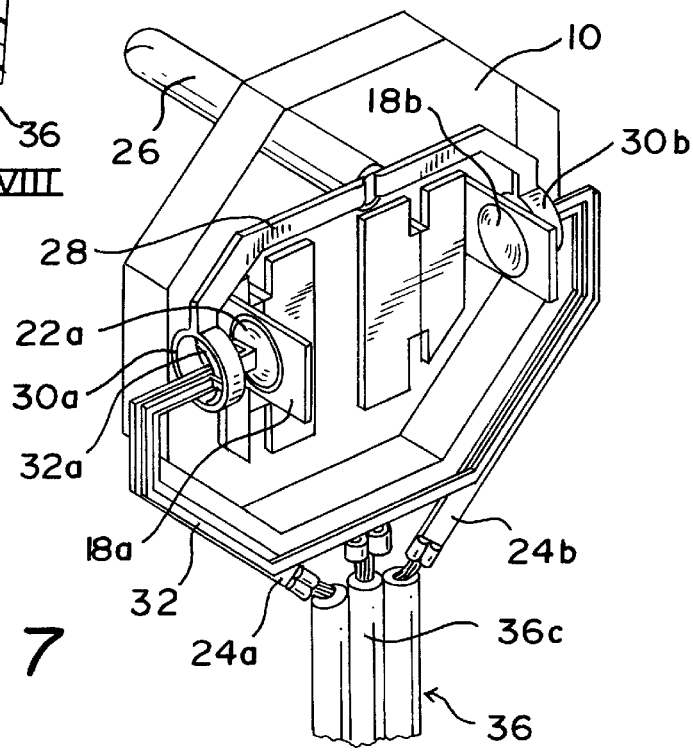
FIG. 7 is a schematic, perspective view of the electrical plug illustrated in FIG. 6.
Figure 9:
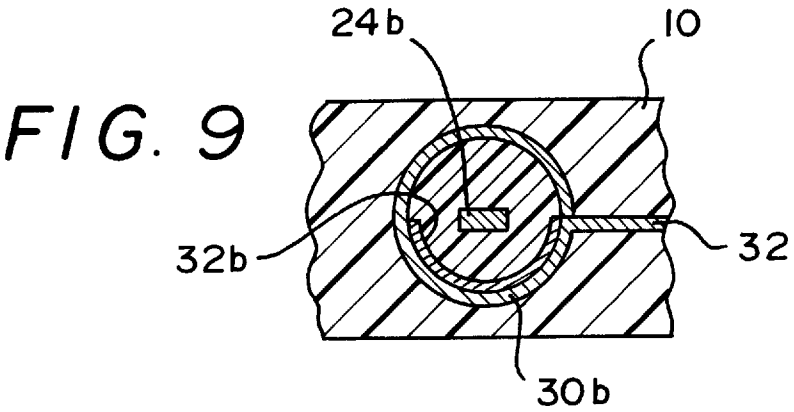
FIG. 9 is a cross-sectional view taken along line IX—IX in FIG. 6.
Figure 10:
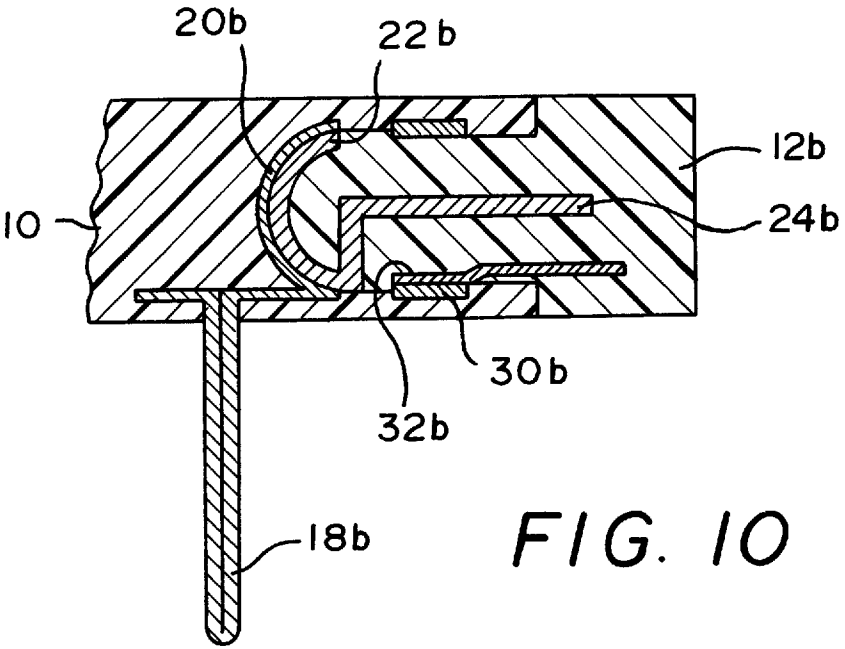
FIG. 10 is a cross-sectional view taken along line X—X in FIG. 6.
Figure 8:
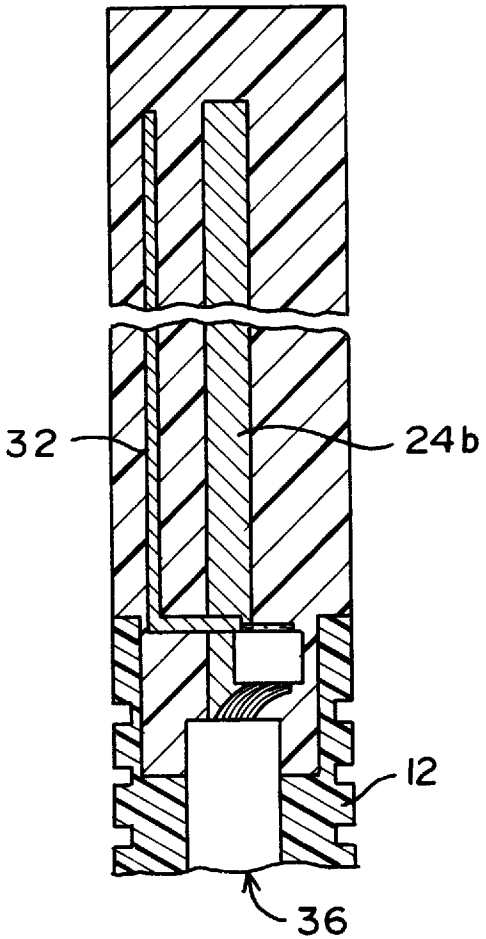
FIG. 8 is a cross-sectional view taken along line VIII—VIII in FIG. 6.
Figure 11:
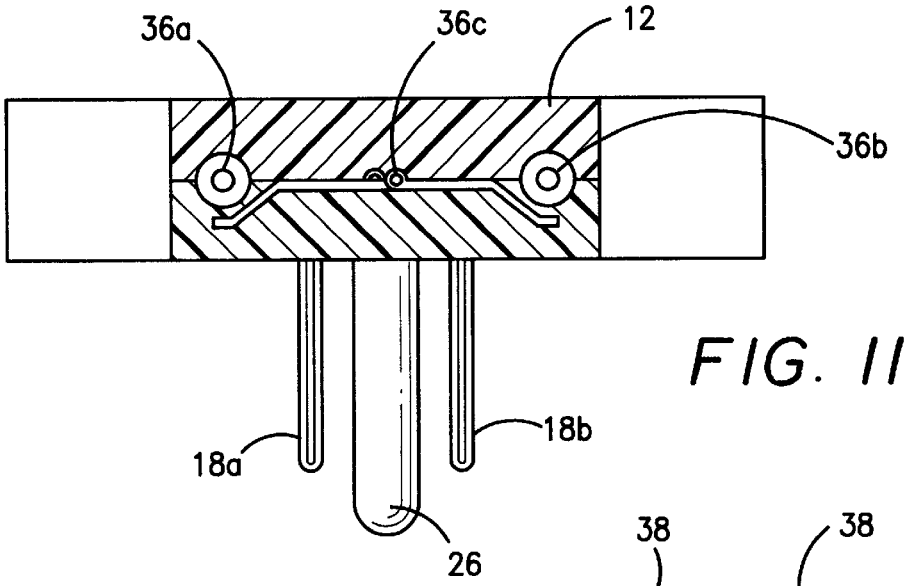
FIG. 11 is a cross-sectional view taken along line XI—XI in FIG. 6.
Figure 22:
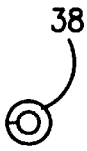
FIG. 22 is an end view of the elongated contact member illustrated in FIG. 21.
Figure 21:
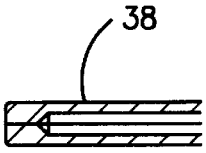
FIG. 21 is a cross-sectional view of the elongated contact member utilized with the embodiment of the plug illustrated in FIG. 16.
Figure 12:
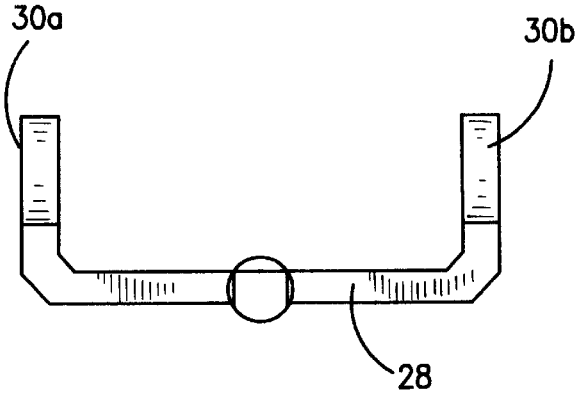
FIG. 12 is a rear view of a first ground plate utilized in the plug illustrated in FIG. 6.
Figure 13:
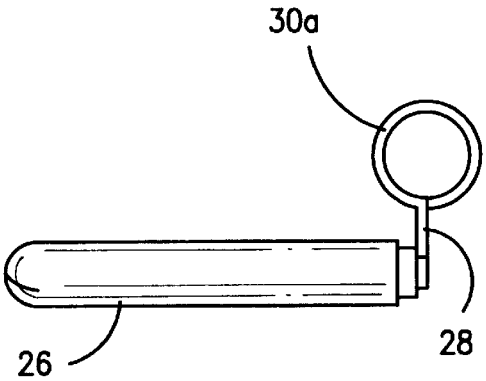
FIG. 13 is a side view of the ground pin and the first ground plate illustrated in FIG. 12.
Figure 14:
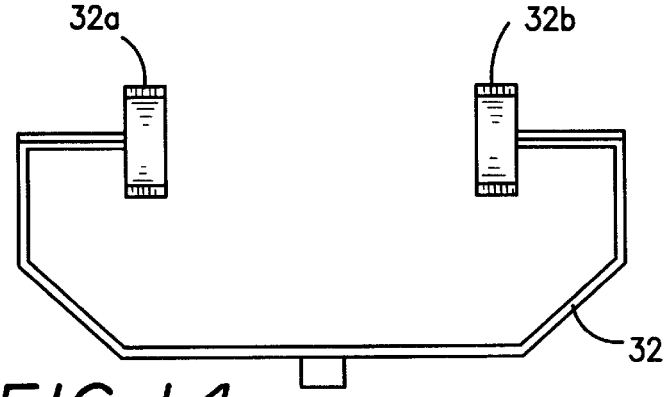
FIG. 14 is a rear view of a second ground plate utilized in the embodiment illustrated in FIG. 6.

A first embodiment of the pivoting electrical plug according to the present invention is illustrated in FIGS. 2–15. This embodiment may be utilized with a two conductor electrical wire, as illustrated in FIGS. 2 and 3, or a three conductor electrical wire as illustrated in FIGS. 6 and 7. The two conductor electrical wire embodiment comprises a plug body 10 and an attachment body 12, connected to the dual conductor electrical wire 14. Plug body 10 has coaxial openings on either side into which are inserted arms 12*a* and 12*b* of attachment body 12 such that plug body 10 and attachment body 12 are pivotable with respect to each other about pivot axis 16. For use with the dual conductor electrical wire 14, plug body 10 will have two conductive pins 18*a*, 18*b* extending therefrom. Although the conductive pins 18*a*, 18*b* will be described and illustrated as comprising generally flat, planar pins configured to engage a standard wall socket, the concepts according to this invention may be utilized with conductive pins having any configuration and located so as to engage any socket configuration. Conductive pins 18*a* and 18*b* have concave, generally hemispherical electrical contacts 20*a* and 20*b*, either formed integrally therewith (as illustrated) or electrically attached to the conductive pins. The concave, generally hemispherical contacts 20*a* and 20*b* each have an axis of symmetry that is coaxial with the pivot axis 16.

Figure 4:
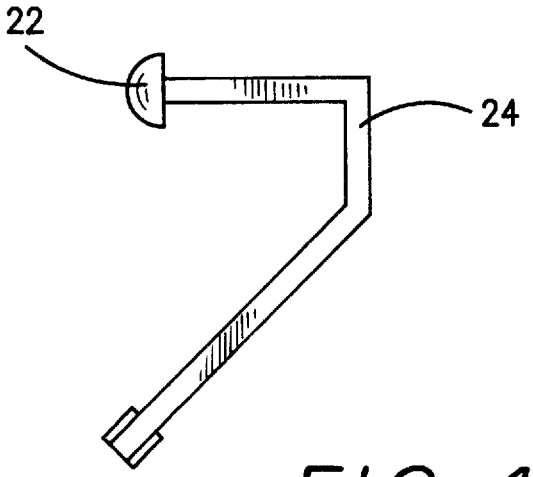
FIG. 4 is a top view of a convex contact and a connecting member utilized in the plug illustrated in FIGS. 2 and 3.

Second contacts 22*a*, 22*b*, in this particular embodiment having a convex, generally hemispherical configuration, are in physical and electrical contact with the concave surfaces of the concave contacts 20*a* and 20*b*, respectively. As can be seen in FIGS. 4 and 5, the convex contacts 22*a*, 22*b*are attached to a connecting member, 24*a*, 24*b*, each of which is, in turn, connected to a conductor 14*a*, 14*b*of the electric wire 14. The convex contacts 22*a* and 22*b* each have an axis of symmetry that is coaxial with the pivot axis 16. The connecting members 24*a*, 24*b* may be formed of resilient material so as to bias the convex contacts 22*a*, 22*b* into physical and electrical contact with concave contacts 20*a*, 20*b*. Thus, during the relative pivoting movement between the plug body and the attachment body 12, electrical contact is maintained between the concave contacts 20*a* and 20*b*, and the convex contacts 22*a*and 22*b*.

Figure 15:
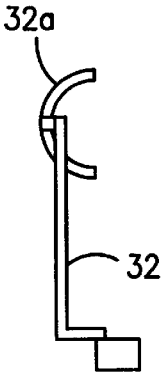
FIG. 15 is a side view of the second ground plate illustrated in FIG. 14.

The aforementioned embodiment may also include a plug body having three conductive pins electrically connected to a three conductor electrical wire, as illustrated in FIGS. 6–15. In these figures, portions of the pivoting electrical plug identical to those in the previously described embodiment illustrated in FIGS. 2–5 have been given the same identifying numerals. The plug body 10 also includes a ground pin 26 extending therefrom which is electrically connected to a first ground plate 28. First ground plate 28 has on either lateral side generally cylindrical first ground contacts 30*a*, 30*b*. The ground contacts 30*a*, 30*b*have axes of symmetry that are located coaxially with the pivot axis 16. A second ground plate 32 is located within the attachment body 12 with second ground contacts 32*a* and 32*b* extending into the plug body. The second ground contacts 32*a*and 32*b* have an arcuate configuration, as best illustrated in FIG. 15, and are sized so as to physically and electrically contact the inner surface of one of the cylindrical ground contacts 30*a*, 30*b*. Again, the second ground contacts 32*a*, 32*b* are coaxially located with respect to the pivot axis 16 such that electrical contact is maintained as the plug body 10 and attachment body 12 are pivoted with respect to each other. The second ground plate 32 is connected to the ground conductor 36*c* of electric wire 36. The two other conductors 36*a*, 36*b* of the electric wire 36 are connected to the connecting members 24*a* and 24*b* as previously described.

Figure 16:
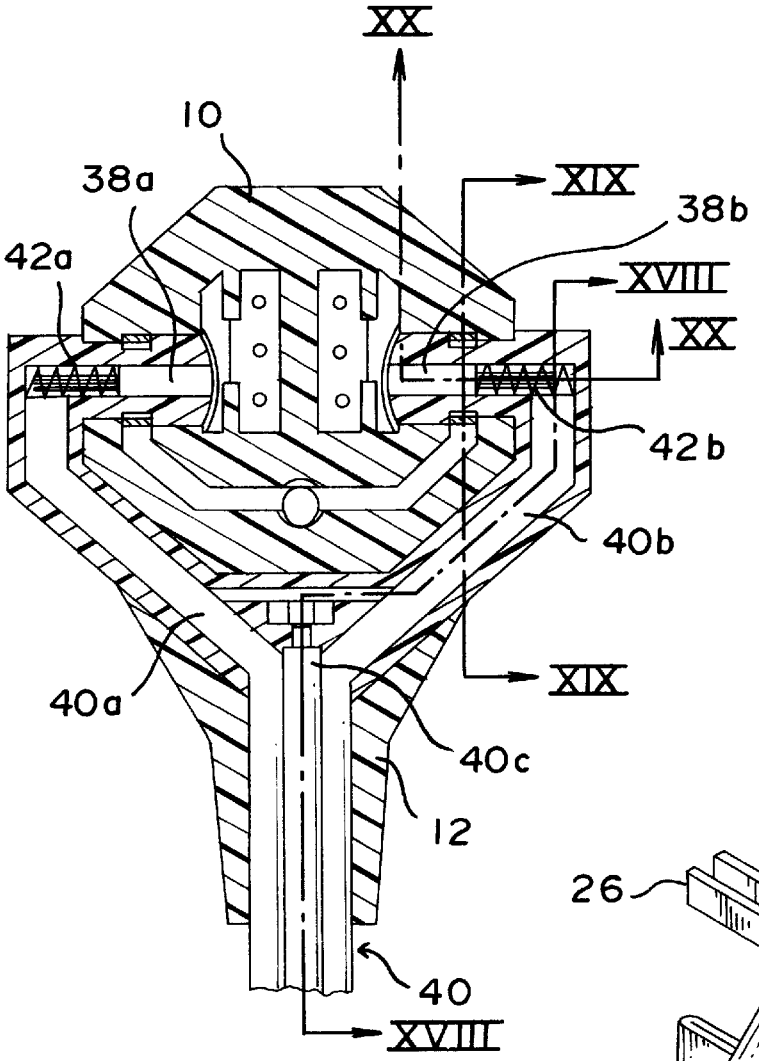
FIG. 16 is a cross-sectional view of a second embodiment of the electrical plug according to the present invention.
Figure 28:
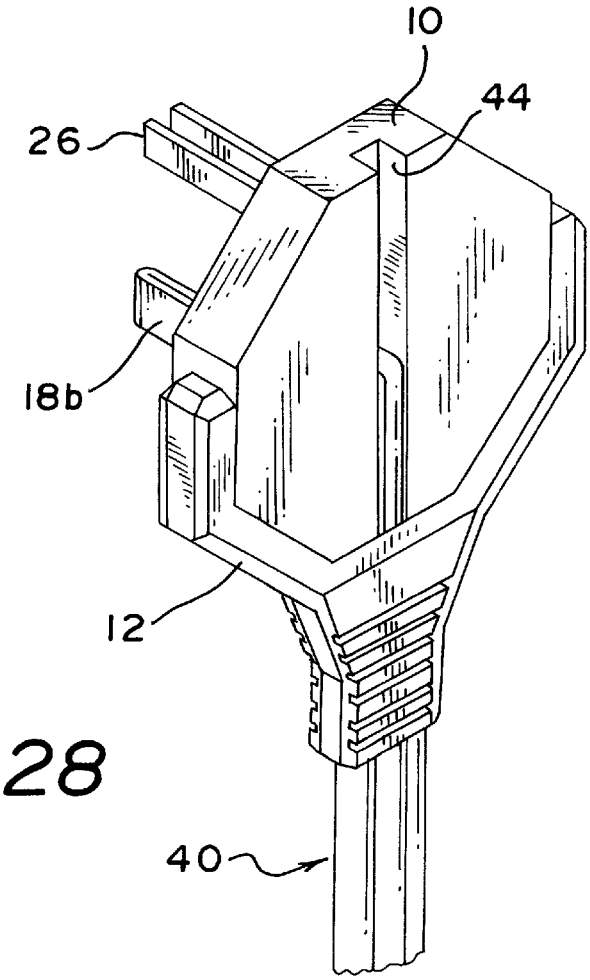
FIG. 28 is a perspective view of the electrical plug illustrated in FIGS. 26 and 27.
Figure 17:
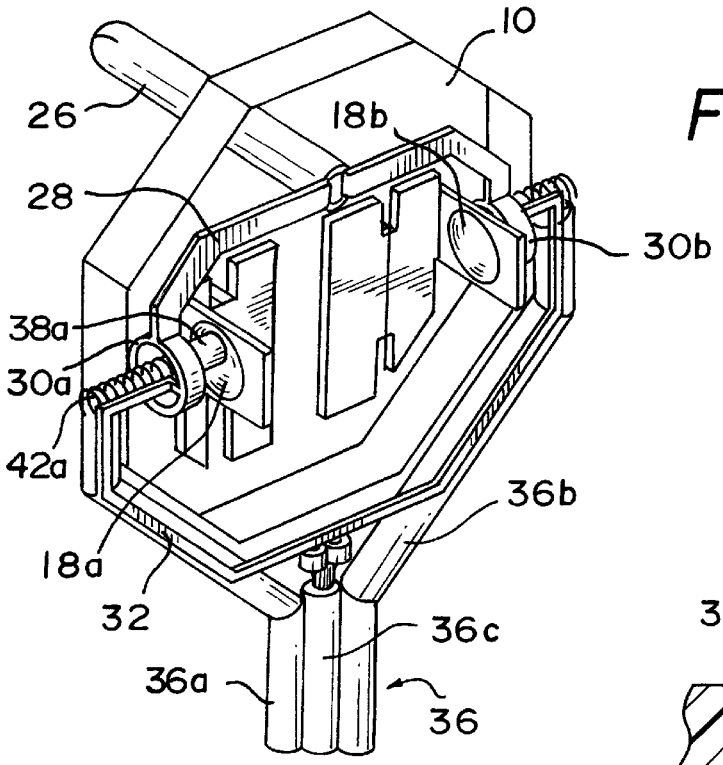
FIG. 17 is a schematic, perspective view of the electrical plug illustrated in FIG. 16.
Figure 19:
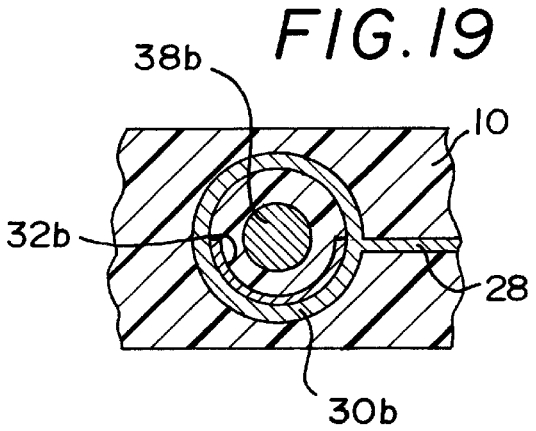
FIG. 19 is a cross-sectional view taken along line XIX—XIX in FIG. 16.
Figure 18:
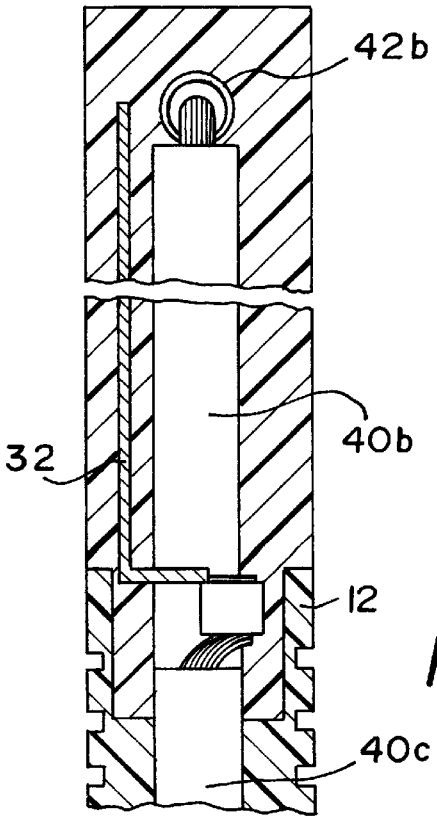
FIG. 18 is a cross-sectional view taken along line XVIII—XVIII in FIG. 16.
Figure 20:
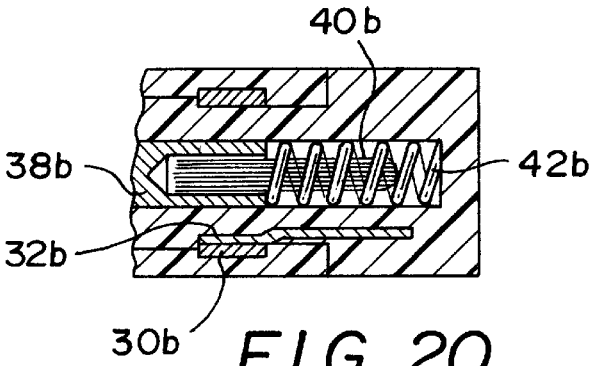
FIG. 20 is a cross-sectional view taken along line XX—XX in FIG. 16.
Figure 23:
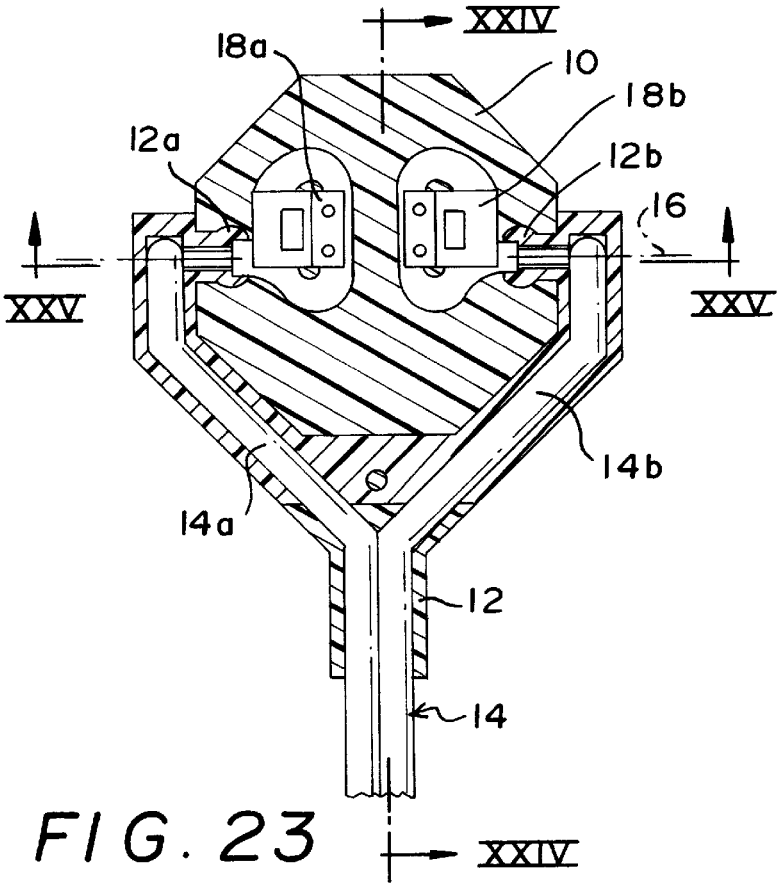
FIG. 23 is a cross-sectional view of a third embodiment of the pivoting electrical plug according to the present invention.
Figure 24:
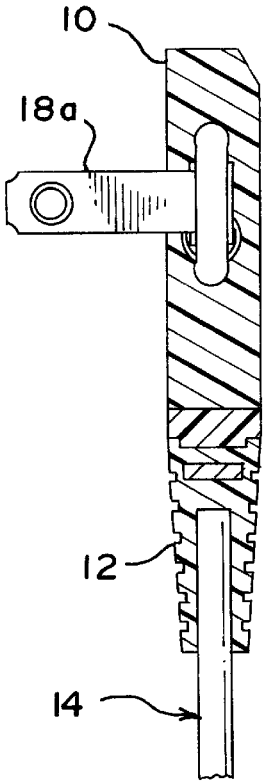
FIG. 24 is a cross-sectional view of the electrical plug illustrated in FIG. 23.
Figure 25:
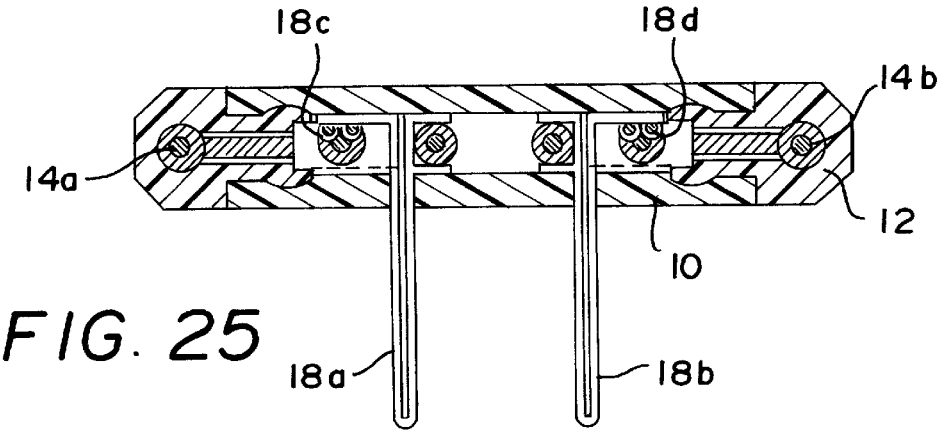
FIG. 25 is a cross-sectional view taken along line XXV—XXV in FIG. 23.
Figure 26:
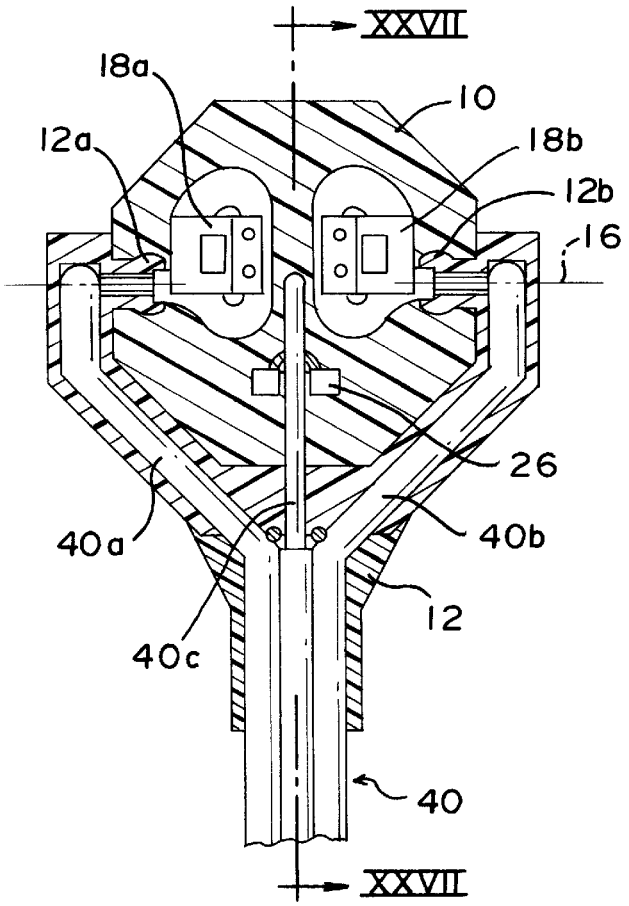
FIG. 26 is a cross-sectional view of the embodiment illustrated in FIG. 23 with a ground pin connected to a ground wire.
Figure 27:
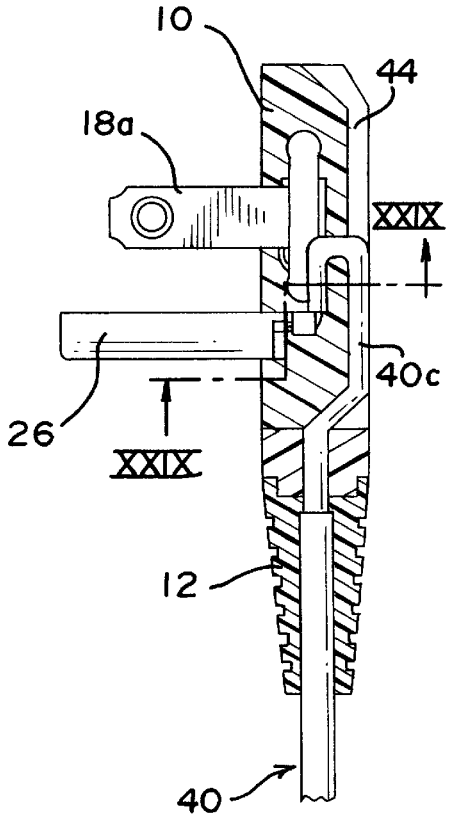
FIG. 27 is a cross-sectional view taken along line XXVII—XXVII in FIG. 26.
Figure 29:
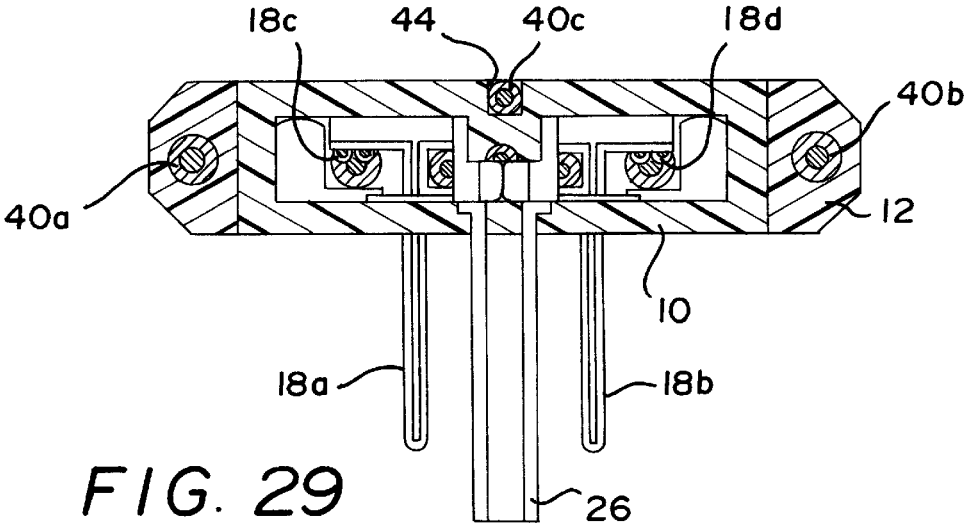
FIG. 29 is a cross-sectional view taken along line XXIX—XXIX in FIG. 27.

A second embodiment of the pivoting electric plug according to the present invention is illustrated in FIGS. 16–22. In this embodiment, the plug body 10, the conductive pins 18*a*, 18*b* and 26, the attachment body 12, the concave contacts 20*a*, 20*b* are the same as in the previously described embodiment. The second embodiment may also be utilized with a three conductor plug body, in which case the first ground plate 28 with contacts 30*a* and 30*b*, as well as the second ground plate 32 with contacts 32*a* and 32*b* are also exactly the same as in the previously described three conductor wire embodiment. As illustrated in FIG. 16, in this embodiment, the convex contacts 22*a* and 22*b* and the connecting members 24*a* and 24*b* have been eliminated and have been replaced by elongated contact members 38*a* and 38*b* directly connected to a conductor 40*a*, 40*b* of the electric wire 40. The elongated contact members 38*a* and 38*b* each comprise an elongated body having an arcuate front section and a hollow rear portion that is connected to a conductor of the wire 40. The elongated contact members 38 have their longitudinal axes of symmetry coaxial with the pivot axis 16 and are urged into physical and electrical contact with the concave surfaces of contacts 20*a* and 20*b* by springs 42*a* and 42*b* interposed between the contact members 38*a* and 38*b* and a portion of the attachment body 12. As best seen in FIG. 16, an insulated portion of the conductors 40*a*, 40*b* extend into a portion of the attachment body 12 with the conductor continuing on further and being electrically and physically attached to one of the elongated contact members 38*a*, 38*b*. Since the elongated contacts 38*a*, 38*b* are located coaxially with respect to the pivot axis, electrical contact is maintained between the wire and the conductive pins as the plug body 10 and the attachment body 12 are pivoted with respect to each other.

Although the embodiment has been described in conjunction with a plug body having three conductive pins and the plug attached to a three conductor electric wire, it is to be understood that this may also be utilized with a two conductor electric wire which would eliminate the ground pin 26 and its associated connection with the ground wire 40*c*. Otherwise, the structure is exactly the same as described for the three conductor electric wire attachment.

A third embodiment of the pivoting electrical plug according to the present invention is illustrated in FIGS. 23–31. In this embodiment, plug body 10 is pivotally connected to attachment body 12 by a pair of ball and socket joints. A ball portion is formed on ends of the arms 12*a* and 12*b* such that they may "snap" into a corresponding recess formed in plug body 10. In this embodiment, the conductors 14*a*, 14*b*of the electric wire 14 extend into the attachment body 12, with a conductor extending through each of the arms 12*a* and 12*b* and into the plug body 10. The conductors are directly attached to conductive pins, 18*a*, 18*b* such as by crimping tabs 18*c*, 18*d* around the respective conductors, or by soldering, etc. The portions of the conductors extending through the arms 12*a* and 12*b* are coaxial with the pivot axis 16 so as not to impede the pivoting ability between the plug body 10 and the attachment body 12.

When this embodiment is utilized with a three conductor electric wire, the plug body 10 has three conductive pins extending therefrom, as illustrated in FIGS. 26–29. The conductive pins 18*a*, 18*b* and the ground pin 26 extend from one side of the plug body 10 and a groove 44 extends across the opposite side of the plug body 10. The ground conductor 40*c* extends from the attachment body 12 into a portion of the groove 44 and passes into the plug body 10 at the pivot axis 16. The ground conductor 40*c* is then physically attached to the ground pin 26 via crimping, soldering, or the like.

Figure 30:
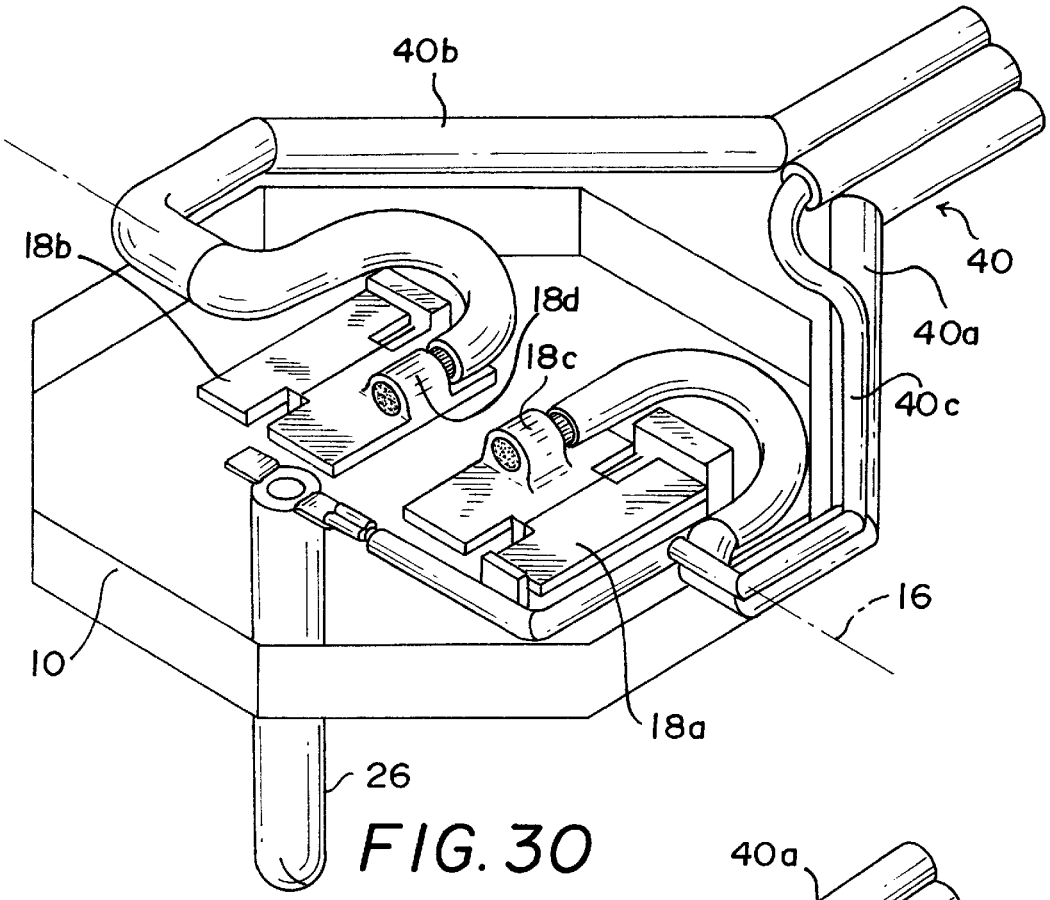
FIG. 30 is a schematic perspective view showing a variation in the third embodiment according to the present invention.
Figure 31:
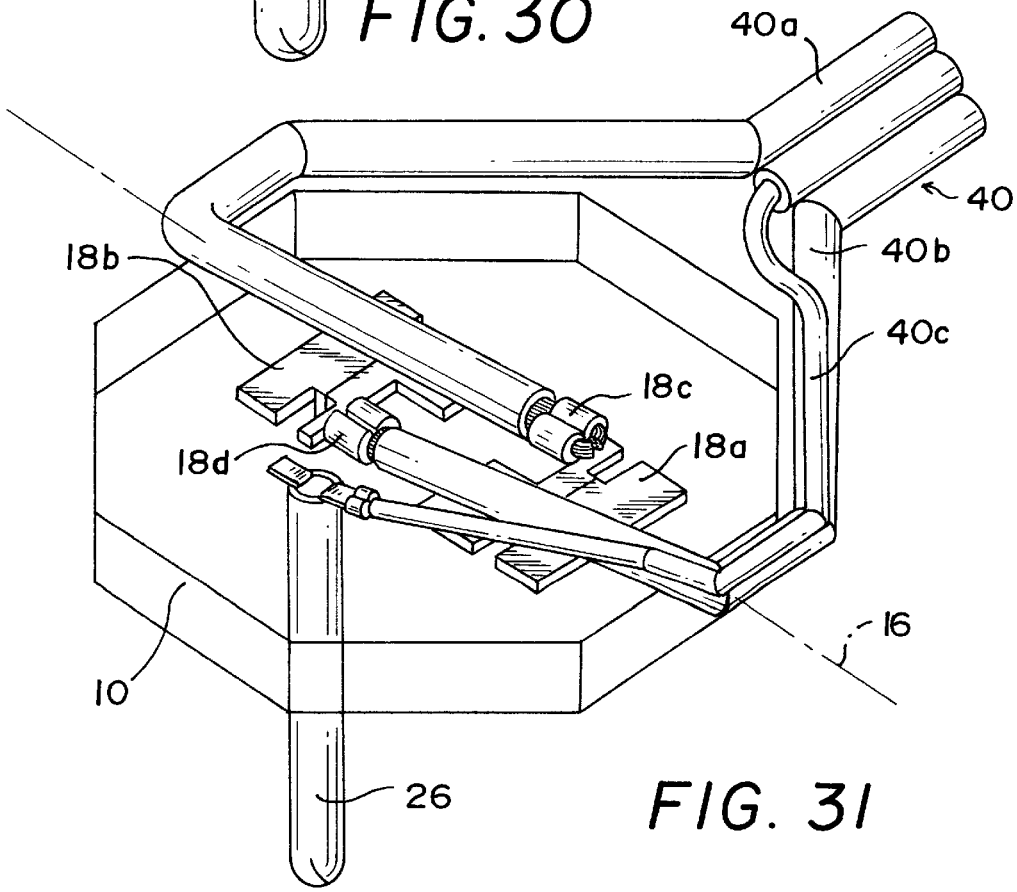
FIG. 31 is a schematic perspective view showing a second variation of the third embodiment according to the present invention.

FIGS. 30 and 31 illustrate variations in the connections between the conductive pins 18*a*, 18*b*, 26 and the conductors 40*a*, 40*b*, 40*c* of wire 40. In each of these variations, the ground conductor 40*c* extends through the attachment body 12 along one of the conductors 40*a*, or 40*b* and passes into the plug body 10 along with the respective conductor coaxially with the pivot axis 16 so as to enable smooth pivoting of the plug body 10 relative to the attachment body 12 and, at the same time, to minimize the potential damage of the electrical conductors due to the pivoting motion. In FIGS. 30 and 31, the attachment body 12 has not been illustrated for the purposes of clarity, but it is to be understood that the physical structure of the attachment body 12, the plug body 10 and their connecting relationships are the same as previously described in relation to the third embodiment illustrated in FIGS. 26–29, except for the groove 44 formed in the plug body 10. In the variations illustrated in FIGS. 30 and 31, since the ground conductor 40*c* passes through the attachment body 12 and into the plug body 10 along the pivot axis 16, groove 44 in the plug body 10 is not necessary.

In FIG. 30, the ground conductor 40*c* extends through the attachment body 12 adjacent to the conductor 40*a* and is attached to ground conductor 26 via crimping, soldering, or the like. In FIG. 31, the ground conductor extends through the attachment body 12 adjacent to conductor 40*b* and, again, passes into the plug body 10 along the pivot axis 16 and is attached to ground pin 26. In this variation, conductor 40*a* enters the plug body 10 on the side of the conductive pin 18*b*, passes over the pin 18*b* and is attached to pin 18*a* via crimping of the tab 18*c* , soldering, or the like. Similarly, conductor 40*b* enters the plug body 10 from the side closest to conductive pin 18, passes over conductive pin 18*a* and is attached to conductive pin 18*b* via clamping of the tab 18*d*, soldering, or the like. This variation of the third embodiment minimizes the turns and curves of the conductors 40*a*, 40*b* and 40*c* both within the plug body 10 and at the pivoting connection between the plug body 10 and the attachment body 12 so as to promote smooth pivoting between the plug body 10 and the attachment body 12 and to minimize potential damage to the electrical wires.

The foregoing description is provided for illustrative purposes only and should not be construed as in any way limiting this invention, the scope of which is defined solely by the appended claims.

I claim:

1. A pivoting electrical plug comprising:

a) a plug body having a face and opposite side edges electrically conductive pin extending therefrom;

b) an attachment body pivotally connected to the plug body such that the plug body and attachment body may pivot with respect to each other about a pivot axis extending through the opposite side edges of the plug body;

c) first and second electrically conductive pins extending from the face of the plug body;

d) a first electrically conductive wire located in the attachment body, passing into the plug body through one of the opposite side edges along the pivot axis and connected to the first electrically conductive pin; and, e) a second electrically conductive wire located in the attachment body; passing into the plug body through another of the opposite side edges along the pivot axis and connected to the second electrically conductive pins.

2. The pivoting electrical plug of claim 1 further comprising a pair of ball and socket joints pivotally connecting the plug body and the attachment body.

3. The pivoting electrical plug of claim 2 wherein the electrically conductive wires passing into the plug body pass through the ball and socket joints along the pivot axis.

4. The pivoting electrical plug of claim 1 wherein the first electrically conductive pin is located adjacent to a first opposite side edge of the plug body and the second electrically conductive pin is located adjacent to a second opposite side edge of the plug body.

5. The pivoting electrical plug of claim 4 wherein the first electrically conductive wire passes through the first opposite side edge and the second electrically conductive wire passes through the second opposite side edge.

6. The pivoting electrical plug of claim 4 wherein the first electrically conductive wire passes through the second opposite side edge and the second electrically conductive wire passes through the first opposite side edge.

7. The pivoting electrical plug of claim 4 further comprising:

a) a third electrically conductive pin extending from the face of the plug body; and, b) a third electrically conductive wire located in the attachment body, passing into the plug body through one of the opposite sides and connected to the third electrically conductive pins.

8. The pivoting electrical plug of claim 7 wherein the first electrically conductive wire passes through the first opposite side edge and the second electrically conductive wire passes through the second opposite side edge.

9. The pivoting electrical plug of claim 7 wherein the first electrically conductive wire passes through the second opposite side edge and the second electrically conductive wire passes through the first opposite side edge.

* * * * *